United States Patent [19]

Roy

[11] Patent Number: 5,040,311

[45] Date of Patent: Aug. 20, 1991

[54] LIQUID FABRIC SOFTENER DISPENSER FOR USE IN DRYERS

[76] Inventor: James Roy, Rte. 2, Spickard, Mo. 64679

[21] Appl. No.: 515,232

[22] Filed: Apr. 27, 1990

[51] Int. Cl.[5] ..... F26B 19/00

[52] U.S. Cl. ..... 34/60; 34/12; 34/9; 34/90

[58] Field of Search ..... 34/60, 12, 9, 71, 90; 206/0.5, 0.7; 222/187, 190, 192

[56] References Cited

U.S. PATENT DOCUMENTS

| | | |
|---|---|---|
| 2,941,309 | 6/1960 | Cobb . |
| 3,706,140 | 12/1972 | Brillaud et al. . |
| 3,736,668 | 6/1973 | Dillarstone . |
| 3,947,971 | 4/1976 | Bauer . |
| 4,014,105 | 3/1977 | Furgal et al. . |
| 4,167,594 | 9/1979 | Schwadtke et al. . |
| 4,183,981 | 1/1980 | Kienzel et al. . |
| 4,254,139 | 3/1981 | Hendrickson et al. . |
| 4,532,719 | 8/1985 | Davies et al. . |
| 4,532,722 | 8/1985 | Bax . |
| 4,567,675 | 2/1986 | Rennie . |
| 4,642,908 | 2/1987 | Brenner . |

*Primary Examiner*—Henry A. Bennet
*Attorney, Agent, or Firm*—Litman, McMahon & Brown

[57] ABSTRACT

A liquid fabric softener dispenser for use in conjunction with dispensing fabric softener on clothes during drying of the clothes in a dryer. The dispenser is constructed of a relatively soft, integral and absorbent material that fills virtually the entire dispenser and is continuous with the exterior thereof except for an a axial bore extending from the surface of the dispenser inward. The bore receives liquid fabric softener poured thereinto through a mouth situated on the surface of the dispenser A sleeve constructed of non-absorbent material surrounds the mouth of the bore and extends partially along the length of the bore in order to prevent liquid fabric softener from overly wetting the mouth of the bore. A cap is utilized in conjunction with the sleeve to permit liquid softener from escaping from the bore. The material of construction of the dispenser is porous throughout and absorbent of the fabric softener such that the fabric softener migrates through the material from the bore to the surface. The fabric softener migrates due to heat and tumbling in the dryer outwardly toward the surface of the dispenser so as to engage clothing coming into contact with the dispenser during tumbling in the dryer.

9 Claims, 1 Drawing Sheet

LIQUID FABRIC SOFTENER DISPENSER FOR USE IN DRYERS

BACKGROUND OF THE INVENTION

The present invention is directed to a liquid fabric softener dispenser for dispensing fabric softener into clothes while the clothes are tumbling and being heated so as to dry in a mechanical dryer.

Numerous liquid and solid fabric softeners exist in the marketplace which are used during washing or drying of clothes for preventing the buildup of static electricity on the clothes, softening the clothes and the like during the drying of the clothes subsequent to washing. Modern electric and gas heated dryers are well known for their ability to produce static cling in clothes unless a fabric softener is utilized.

The first major types of fabric softeners are generally referred to as liquid fabric softeners, such as is sold under the trademark "Downey" and that are generally utilized while clothes are being washed in a washing machine. Although liquid fabric softeners are relatively inexpensive, a large portion of the fabric softener used in washing machines is wasted as it is discharged from the washing machine with the wastewater.

The second major types of fabric softeners are normally offered as solid fabric softener carrier sheets, such as are marketed under the trademark "Bounce", and that are placed in a dryer with the wet clothes during drying. The sheet fabric softeners are generally more expensive as compared to the liquid types based on a per usage basis. Consequently, attempts have been made to utilize liquid fabric softeners within dryers. However, the liquid softeners may spot or stain clothing where it is allowed to "wet" the surface of the clothing; therefore, liquid fabric softeners have never been successfully dispensed directly onto the clothes in the dryer.

Still further attempts have been made to utilize liquid fabric softener within dryers through an indirect dispenser by placing the softener within a dispenser. A typical type of structure utilized for this purpose consisted of a hard spherical shell with numerous dispensing small ports therein. The fabric softener was poured into the interior of the shell which was then closed and the shell was placed in the dryer. During tumbling, the liquid bounced against the side of the shell and small amounts of the softener squirted out onto the clothes. Control of the softener in this manner is relatively difficult and spotting can occur where droplets engage the clothes.

A second type of dispenser of this type included a hard shell or soft bag-like structure filled with loose strands of absorbent fabric. While this structure provided a potentially more even distribution of the softener, the loose fabric has a tendency to become released from the device, so that some become undesirably mixed with the clothing, with frequent usage and these devices were quite difficult to quickly and accurately refill with fabric softener. Additionally, these devices had a relatively limited life expectancy due to breakdown of the components thereof.

OBJECTS OF THE INVENTION

Therefore, the objects of the present invention are: to provide a fabric softener dispenser for use in effectively distributing liquid fabric softener in a mechanical clothes dryer; to provide such a dispenser that distributes fabric softener in a relatively slow and controlled manner during tumbling and heating within the clothes dryer; to provide such a dispenser that is usable and effective through many drying cycles; to provide such a dispenser which is relatively easy to recharge with fabric softener and to use; to provide such a dispenser which is unlikely to damage clothing due to hard surfaces on the dispenser or to produce splotches of liquid fabric softener on clothing being dried in a dryer; to provide such a dispenser that will remain integrated through numerous uses; and to provide such a dispenser which is relatively inexpensive to manufacture, extremely easy to use and particularly well adapted for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
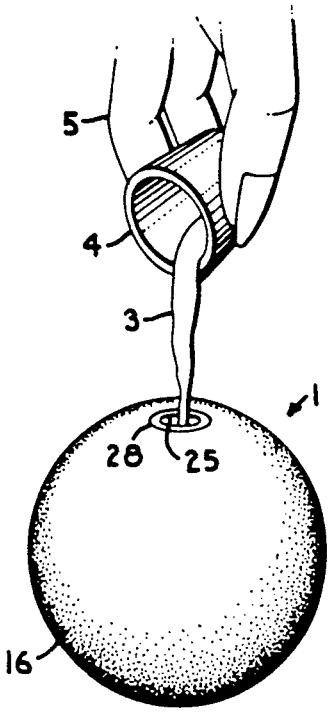
FIG. 1 is a perspective view of a liquid fabric softener dispenser in accordance with the present invention being filled with fabric softener.
Figure 3:
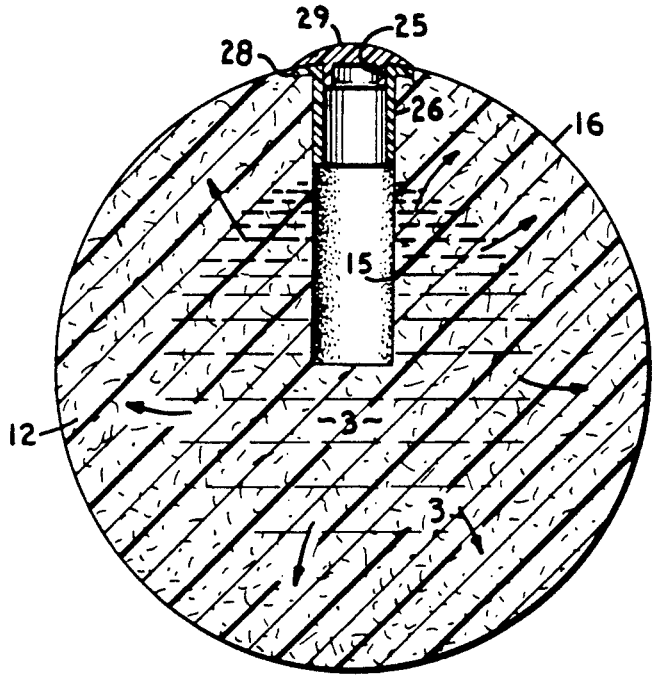
FIG. 3 is an enlarged cross-sectional view of the dispenser, taken along line 3—3 of FIG. 2.
Figure 2:
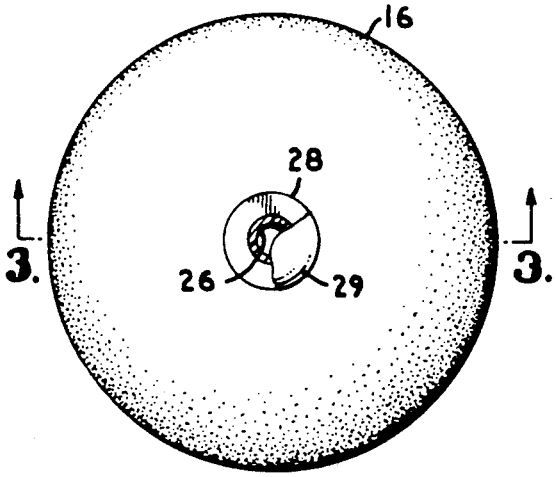
FIG. 2 is an enlarged top plan view of the dispenser.
Figure 4:
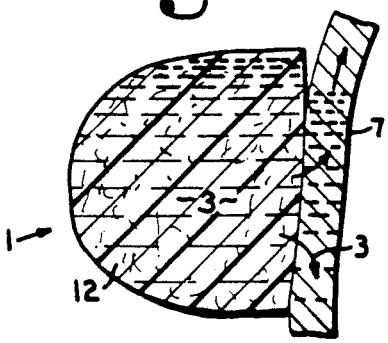
FIG. 4 is an enlarged and fragmentary cross-sectional view of the dispenser, similar to FIG. 3, shown in contact with clothing being dried.

The reference numeral 1 generally identifies a liquid fabric softener dispenser in accordance with the present invention. The dispenser 1 is illustrated in FIG. 1 being recharged with liquid fabric softener 3 from a cup 4 by a user thereof 5. FIG. 4 illustrates the dispenser 1 in contact with clothing 7 in a conventional mechanical clothes dryer (not shown) with tumbling and heating supplied by the clothes dryer.

The dispenser 1 is preferably constructed of a generally uniform, porous fabric or flexible foam material 12 except for an axially aligned bore 15 extending from a surface 16 of the dispenser 1 toward the center thereof. Preferably, the dispenser 1 has a body 12 constructed of an expanded polyurethane, polyether or like material having a soft, flexible and porous structure suitable for absorbing the liquid fabric softener 3 and allowing same to migrate due to absorption, heat, tumbling and the like from the bore 15 to the surface 16 under controlled conditions so that only a small amount of the softener 3 is located at the surface 16 at any time during use so as to provide only enough softener 3 to the clothing 7 to condition and not "wet" the clothing 7. A highly suitable material are the flexible foam polyurethanes or polyethers from which soft impact balls and the like are made commonly sold under the trademark "Nerf" balls.

The dispenser 1 is a three dimensional structure adapted to tumble during drying processes and mix with the clothing 7 so that softener 3 passes from the device 1 to the clothes 7, as shown in FIG. 4. Preferably, the dispenser 1 has a closed spherical structure or ball shape having a surface 16 and interior that are constructed of substantially the same uniform material so as to present a soft pliable surface 16 to clothing 7 while the clothing 7 is being dried. A suitable size for the dispenser 1 has been found to be approximately four inches in diameter, although other sizes and shapes can also be utilized. The spherical shape of the dispenser 1 provides good tumbling action and functions to uniformly dispense the softener 3 from the dispenser 1.

The bore 15, for a four inch dispenser 1, is preferably approximately two inches in length and about three-eighths to one-half inch in diameter. The purpose of the bore 15 is to allow the liquid fabric softener 3 to be easily and quickly poured into the center of the dispenser 1 for recharging the dispenser 1 with fabric softener 3. As the fabric softener 3 is poured into the bore 15, as illustrated in FIG. 1, the fabric softener 3 is quickly absorbed into the fabric material of the dispenser 1. Normally, approximately one-fourth of an ounce of liquid fabric softener 3 is poured into the bore 15 for a conventional home dryer. Larger amounts may be utilized (for example, one to one and one-half ounces in layer dryers or for special requirements). For most smaller amounts of softener 3, the liquid softener 3 is absorbed very quickly and will not then pour out of the bore 15 when the device 1 is turned upside down even immediately after filling.

Located at an entrance or mouth 25 of the bore 15 and extending therealong for approximately one-fourth the length of the bore 15 is a sleeve 26. The sleeve 26 is of a cylindrical construction and is manufactured from a material that is generally non-absorbent of the liquid fabric softener 3, such as a hard, non-porous plastic. The sleeve 25 also has a lip 28 that extends radially outward along the surface 16 of the dispenser 1 for approximately one-fourth of an inch. The sleeve 26 is secured in the bore 15 by gluing or the like. The purpose of the sleeve 26 is to prevent the liquid fabric softener 3 from overly wetting the dispenser 1 at the mouth 25 of the bore 15 so as to limit the clothes 7 from being overly wetted with the fabric softener 3 during use by engagement with this region of the dispenser 1.

A cap 29 is sealably positioned in the sleeve 26 at the bore mouth 25. The cap 29 may be utilized when the user desires to fill the bore 15 with more fabric softener 3 than will be readily absorbed before the user wishes to use the dispenser 1. In this manner, the cap 29 prevents the additional fabric softener 3 from escaping from the dispenser 1 until it is absorbed.

In use, the dispenser 1 is inserted in a clothes dryer along with clothing 7 to be dried thereby. The dryer heats and tumbles the clothing 7, the dispenser 1 engages the clothing 7 in a manner, such as is illustrated in FIG. 4. The heating and tumbling of the dispenser 1 causes the liquid fabric softener 3 therein to slowly migrate to the exterior surface 16 and transfer to clothing 7 adjacent to the device 1 in sufficiently small quantities so as to prevent overly wetting or staining of the clothing 7.

After approximately each ten uses, the dispenser 1 may be placed in a washer with clothes being washed to remove residual buildup within the dispenser 1 so a to maintain the dispenser 1 available for use indefinitely. It is foreseen that the dispenser 1 can be constructed of any uniform and lightweight absorbent material, either material (such as sponge or synthetic) suitable for the requirements of the invention.

It is to be understood that while certain forms of the present invention have been illustrated and described herein, it is not to be limited to the specific forms or arrangement of parts described and shown.

What is claimed and desired to be secured by Letters Patent is as follows:

1. A dispenser for use in dispensing a liquid fabric softener to clothing; said dispenser comprising:
   (a) a dispenser body having an interior constructed of and substantially completely filled with a flexible and porous polymer foam adapted to absorb liquid fabric softener;
   (b) said dispenser body having a surface adapted to engage clothing durng tumbling with clothing in a clothes dryer; said dispenser surface being constructed of the same material as said dispenser interior and being continuous therewith; and
   (c) recharging means for allowing a user to place liquid fabric softener in said dispenser interior;
   (d) whereby during use the fabric softener is adapted to migrate from said dispenser interior to said surface thereof so as to be placed in contact with clothes being dried.

2. The dispenser according to claim 1 wherein:
   (a) said recharging means comprise a bore extending radially from said dispenser surface to near a center of said body.

3. The dispenser according to claim 2 wherein:
   (a) said bore includes a mouth at said dispenser surface; and including:
   (b) a non-absorbent sleeve secured in said bore and extending substantially along said bore from said mouth.

4. The dispenser according to claim 3 wherein:
   (a) said sleeve includes a lip extending radially outward along said dispenser surface.

5. The dispenser according to claim 2 including:
   (a) a removable cap for selectively closing said bore mouth.

6. In a liquid fabric softener dispenser for use in a tumble clothes dryer; the improvement comprising:
   (a) said dispenser having an interior and a surface with a recharging bore extending from said surface into said interior; and wherein:
   (b) said interior and said surface except for said bore are entirely constructed as a single piece of a flexible and absorbent polymer foam.

7. A dispenser for use in dispensing a liquid fabric softener to clothing being dried in a tumble type mechanical dryer; said dispenser comprising:
   (a) a ball having an interior and an exterior surface;
   (b) a bore extending substantially radially from said surface to near a center of said ball;
   (c) said ball except for said bore being constructed of a generally uniform, continuous and one piece polymer foam; said foam being porous and flexible and adapted to allow liquid fabric softener placed in said bore to migrate through said foam to said surface during tumbling in the dryer so as to engage the clothes; and (d) a non-absorbent sleeve positioned in said bore and extending from said surface substantially along said bore and being adapted to prevent over-wetting of a mouth of said bore during placement of the liquid fabric softener into said bore.

8. A dispenser for use in dispensing a liquid fabric softener to clothing; said dispenser comprising:

(a) a dispenser body having an interior constructed of and substantially completed filled with a flexible and porous material adapted to absorb liquid fabric softener;

(b) said dispenser body having a surface adapted to engage clothing during tumbling with clothing in a clothes dryer; said dispenser surface being constructed of the same material as said dispenser interior and being continuous therewith; said material of construction of said body being a porous and flexible polyether polymer foam; and (c) recharging means for allowing a user to place liquid fabric softener in said dispenser interior;

(d) wherein during use the fabric softener is adapted to migrate from said dispenser interior to said surface thereof so as to be placed in contact with clothes being dried.

9. A dispenser for use in dispensing a liquid fabric softener to clothing; said dispenser comprising:

(a) a dispenser body having an interior constructed of and substantially completely filled with a flexible and porous material adapted to absorb liquid fabric softener;

(b) said dispenser body having a surface adapted to engage clothing during tumbling with clothing in a clothes dryer; said dispenser surface being constructed of the same material as said dispenser interior and being continuous therewith; said material of construction of said body being a porous and flexible polymer foam; said body interior and surface except for said bore are integral and continuous and of a one piece construction; and (c) recharging means for allowing a user to place liquid fabric softener in said dispenser interior;

(d) wherein during use the fabric softener is adapted to migrate from said dispenser interior to said surface thereof so as to be placed in contact with clothes being dried.

* * * * *